United States Patent [19]

Underwood

[11] Patent Number: 4,815,954

[45] Date of Patent: Mar. 28, 1989

[54] OFFSET THREE-GEAR, TWO-SYSTEM PUMP

[75] Inventor: Herbert N. Underwood, Chicago, Ill.

[73] Assignee: Borg Warner Corporation, Chicago, Ill.

[21] Appl. No.: 674,890

[22] Filed: Nov. 26, 1984

[51] Int. Cl.[4] ..... F04C 2/24; F04B 49/00

[52] U.S. Cl. ..... 418/196; 417/283

[58] Field of Search ..... 418/191, 196, 197; 417/283, 288

[56] References Cited

U.S. PATENT DOCUMENTS

| | | | |
|---|---|---|---|
| 1,585,731 | 5/1926 | Oakes | 184/31 |
| 3,447,422 | 6/1969 | Bidlack et al. | 91/89 |
| 3,627,455 | 12/1971 | Nasvytis | 418/196 |
| 3,639,088 | 2/1972 | Moog, Jr. | 418/74 |
| 4,184,808 | 1/1980 | Cobb | 417/348 |
| 4,204,811 | 5/1980 | Carter et al. | 417/283 |

*Primary Examiner*—Carlton R. Croyle

*Assistant Examiner*—Leonard P. Walnoha

*Attorney, Agent, or Firm*—Julian Schachner; James A. Geppert

[57] ABSTRACT

An offset three-gear, two-system pump includes first, second, and third overlapping chambers. First inlet and low-pressure outlet ports communicate with the first and second chambers, and second inlet and high-pressure pressure outlet ports communicate with the first and third chambers. The first chamber has a short wall portion extending from the low-pressure outlet port to the second inlet port, and a long wall portion extending from the high-pressure outlet port to the first inlet port. First, second, and third gears are respectively rotatable in the chambers. The first and second gears form a low-pressure gear set, and the first and third gears form a high-pressure gear set. A small number of first gear teeth are cooperable with the short wall portion and a large number of first gear teeth are cooperable with the long wall portion to effect sealing against leakage from the pressure ports to the inlet ports.

3 Claims, 1 Drawing Sheet

Fig. 1.
(PRIOR ART)
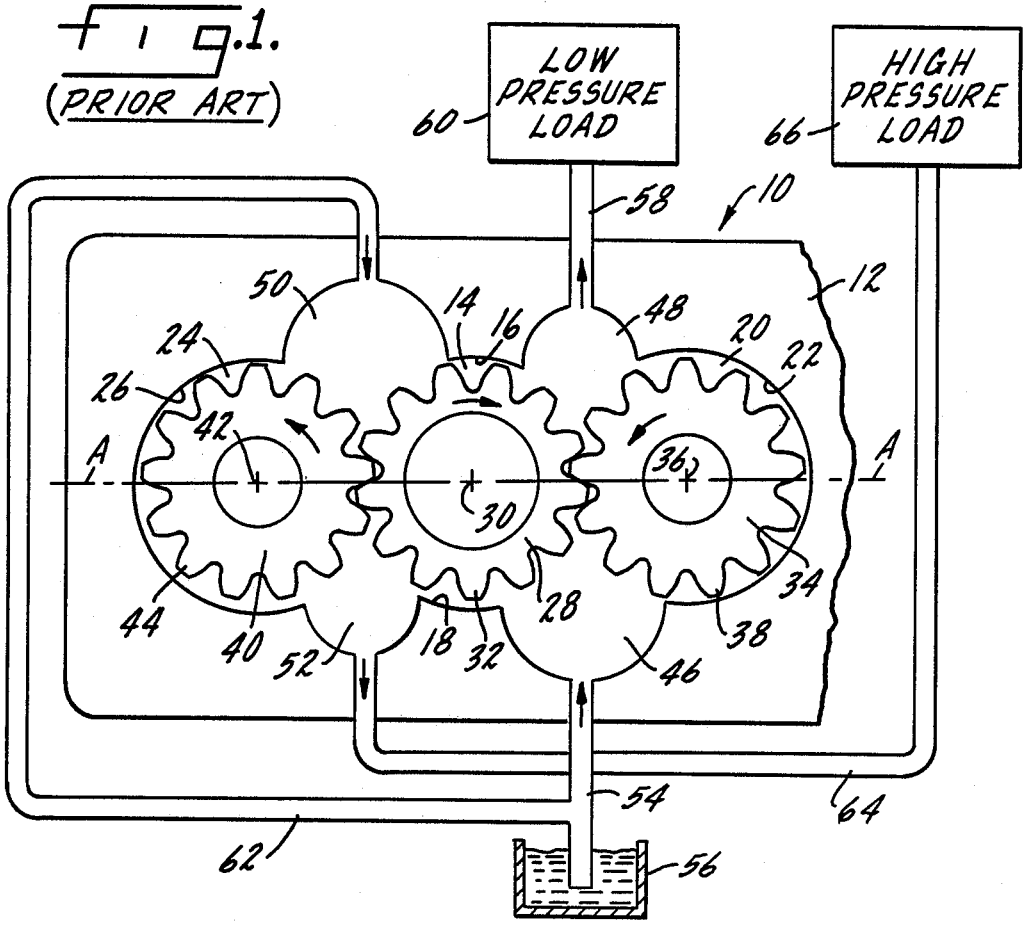
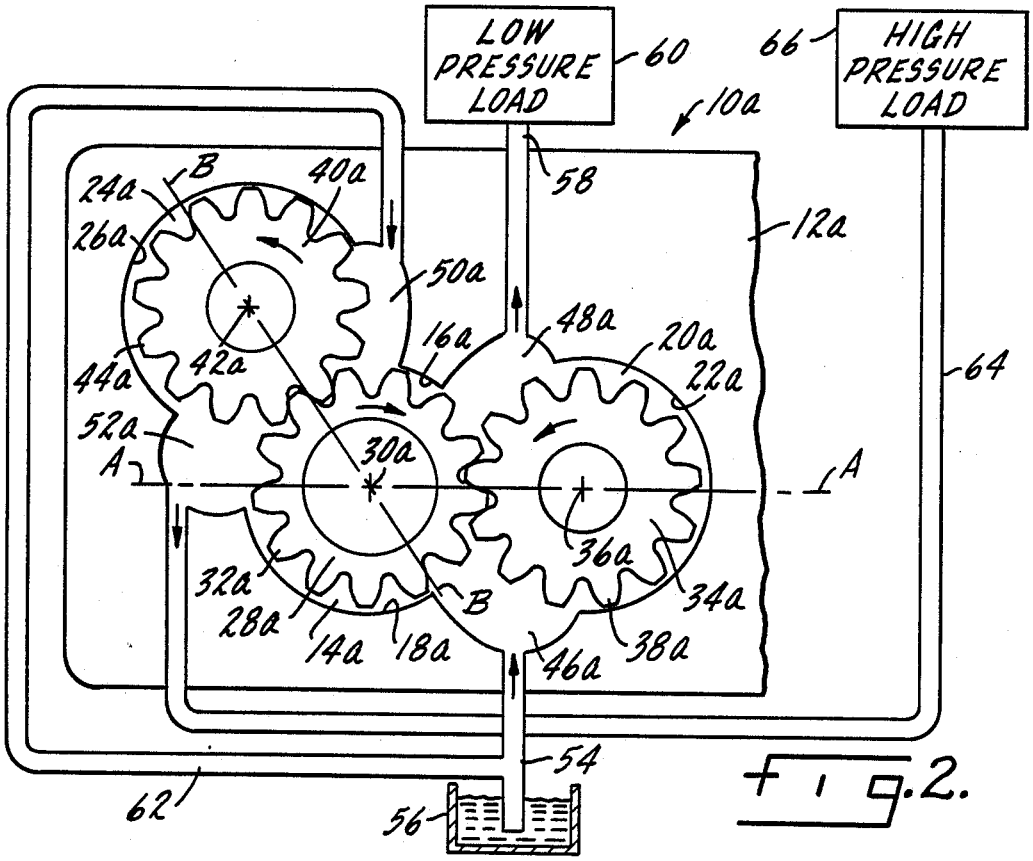
Fig. 2.

OFFSET THREE-GEAR, TWO-SYSTEM PUMP

BACKGROUND OF THE INVENTION

This invention relates generally to a two-system pump. More particularily, it relates to a three-gear, two-system pump wherein one of the gears is offset so as to improve the sealing characteristics of the high-pressure system without detracting significantly from the sealing characteristics of the low-pressure system.

Gear pumps are well known in the prior art. The typical gear pump comprises a housing defining a pump chamber within which two meshing gears rotate. As they rotate, fluid is drawn into the chamber at a relatively low inlet pressure, and is directed out of the chamber at a relatively high outlet pressure.

Gear pumps are useful for suppling fluid to a wide variety of machines In many machines different pressure levels of fluid are required for operating different loads. In the prior art these requirements have been met primarily through the use of seperate gear pumps, each designed for supplying fluid at a particular pressure level Alternatively, prior art gear pumps include multiple pump stages, with outputs connected between the stages for obtaining different pressure levels. These pumps have disadvantages in that they require an excessive number of pumping gears and pump control devices Thus they are costly and bulky.

These disadvantages are overcome by a three-gear, two-system pump. Such a pump is disclosed in U.S. Pat. No. 4,204,811 issued May 27, 1980. This pump comprises three gears, the center one of which meshes with the other two such that the gears form part of two pumping systems with two simultaneously rotatable pumping gear sets. Two inlet ports are provided, along with high- and low-pressure outlet ports Upon rotation the pumping gears draw fluid through the inlet ports. The low-pressure gear set discharges fluid through the low-pressure outlet port, and the high-pressure gear set discharges fluid through the high-pressure outlet port. The relatively low pressure differential between the low-pressure outlet port and its adjacent inlet port does not pose a leakage problem. However, the relatively high pressure differential between the high-pressure outlet port and its adjacent inlet port may present a significant leakage problem. Thus there remains a need in the art for a three-gear, two-system pump in which this leakage is reduced to thereby render the high-pressure system more efficient than that of similar pumps currently available.

SUMMARY OF THE INVENTION

This invention is directed to meeting this need. To that end there is provided an offset three-gear, two-system pump which includes first, second, and third overlapping chambers A first inlet port and a low-pressure outlet port communicate with the first and second chambers Similarly, a second inlet port and a high-pressure outlet port communicate with the first and third chambers The first chamber has a relatively short wall portion extending from the low-pressure outlet port to the second inlet port, and a relatively long wall portion extending from the high-pressure outlet port to the first inlet port. First, second, and third gears are respectively rotatable in the chambers. The first and second gears mesh to form a low-pressure system pumping gear set, and the first and third gears mesh to form a high-pressure system pumping gear set. A relatively small number of first gear teeth are cooperable with the short wall portion and a relatively large number of first gear teeth are cooperable with the long wall portion to effect sealing against leakage from the pressure ports to the inlet ports.

BRIEF DESCRIPTION OF THE DRAWING

The objects and advantages of this invention will become apparent to those skilled in the art upon careful consideration of the specification herein, including the drawing, wherein:

FIG. 1 is a schematic illustration of a three-gear, two-system pump known in the prior art; and FIG. 2 is a schematic illustration of the offset three-gear, two system pump of this invention.

While this invention may be embodied in many different forms, the preferred embodiment is illustrated in FIG. 2 of the drawing and is described in detail. It should be understood that the present disclosure is considered to be an exemplification of the principles of the invention, and is not intended to limit the invention to this embodiment.

DESCRIPTION OF THE PRIOR ART

Turning now to the drawing in greater detail, and to FIG. 1 in particular, reference number 10 identifies a typical three-gear, two-system pump known in the prior art. Pump 10 includes a housing 12 which defines a first chamber 14 having first and second wall portions 16 and 18, a second chamber 20 having a wall portion 22, and a third chamber 24 having a wall portion 26. Chambers 14, 20 and 24 overlap and are oriented in-line along a first pump axis A.

A first gear 28 is rotatable in chamber 14 on a first gear axis 30. This gear defines teeth 32. A second gear 34 is rotatable in chamber 20 on a second gear axis 36, and defines teeth 38. A third gear 40, rotatable in chamber 24 on a third gear axis 42, defines teeth 44. Gear axes 30, 36, and 42 are substantially parallel and define pump axis A.

Housing 12 also defines a first inlet port 46 and a low-pressure outlet port 48. These ports communicate with chambers 14 and 20 on opposite side of gears 28 and 34. Housing 12 further defines a second inlet port 50 and a high-pressure outlet port 52 in communication with chambers 14 and 24 on opposite sides of gears 28 and 40.

Inlet port 46 communicates through a suitable line 54 with a fluid reservoir 56, and low-pressure outlet port 48 communicates through a suitable line 58 with a low-pressure load 60, for example a lubrication system. Similarly, inlet port 50 communicates through a suitable line 62 with reservoir 56, and high-pressure outlet port 52 communicates through a suitable line 64 with a high-pressure load 66, for example a fluid power system.

Gears 28 and 34 define a low-pressure system pumping gear set 28,34 for delivering fluid at a relatively low pressure to load 60. Similarly, gears 28 and 40 define a high-pressure system pumping gear set 28,40 for delivering fluid at a relatively high pressure to load 66.

If pump 10 were a single-system pump, ports 48 and 52 would be in communication with a single load, and the pressure in these ports would be balanced. However, as pump 10 is a two-system pump, port 48 is in communication with low-pressure load 60, and port 52 communicates with high-pressure load 66. Gear set 28,34 developes a relatively low pressure in port 48, while at the same time gear set 28,40 developes a relatively high pressure in port 52. Thus there is a pressure differential between ports 52 and 48. This pressure differential generates a biasing force which tends to move gear 28 away from port 52. The result is that the sealing effect of teeth 32 and wall portion 16 is enhanced, whereas the sealing effect of teeth 32 and wall portion 18 is degraded In other words, leakage from port 48 to port 50 is reduced, but leakage from port 52 to port 46 is increased. This increased leakage reduces the efficiency of the high-pressure system of pump 10.

Reducing leakage from port 52 to port 46, thereby improving pump efficiency, is a primary goal of this invention.

DESCRIPTION OF THE PREFERRED EMBODIMENT

Turning now to FIG. 2, in the preferred embodiment reference number 10*a* identifies the three-gear, two-system pump of this invention. Pump 10*a* includes a housing 12*a* which defines a first chamber 14*a* having first and second wall portions 16*a* and 18*a*. Housing 12*a* also defines a second chamber 20*a* having a wall portion 22*a*, and a third chamber 24*a* having a wall portion 26*a*.

Chambers 14*a* and 20*a* overlap and are oriented in-line along pump axis A. Chambers 14*a* and 24*a* overlap and are oriented in-line along a second pump axis B oriented transversely relative to pump axis A.

A first gear 28*a* is rotatable in chamber 14*a* on a first gear axis 30*a*. This gear defines teeth 32*a*. A second gear 34*a* is rotatable in chamber 20*a* on a second gear axis 36*a*, and defines teeth 38*a*. A third gear 40*a*, rotatable in chamber 24*a* on a third gear axis 42*a*, defines teeth 44*a*. Gear axes 30*a*, 36*a* and 42*a* are substantially parallel Gear axes 30*a* and 36*a* define pump axis A, and gear axes 30*a* and 42*a* define pump axis B. Pump axes A and B intersect on gear axis 30*a*.

Housing 12*a*. also defines a first inlet port 46*a* and a low-pressure outlet port 48*a*. Ports 46*a* and 48*a* are in communication with chambers 14*a* and 20*a* on opposite sides of gears 28*a* and 34*a*. Housing 12*a* further defines a second inlet port 50*a* and a high-pressure outlet port 52*a* in communication with chambers 14*a* and 24*a* on opposite sides of gears 28*a* and 40*a*.

Inlet port 46*a* communicates through line 54 with fluid reservoir 56, and low-pressure outlet port 48*a* communicates through line 58 with low-pressure load 60. Similarly, inlet port 50*a* communicates through line 62 with reservoir 56, and high-pressure outlet port 52*a* communicates through line 64 with high-pressure load 66.

Gears 28*a* and 34*a* define a low-pressure system pumping gear set 28*a*,34*a* for delivering fluid at a relatively low pressure to load 60 Similarly, gears 28*a* and 40*a* define a high-pressure system gear set 28*a*,40*a* for delivering fluid at a relatively high pressure to load 66.

Comparing FIG. 2 with FIG. 1, it will be noted that wall portion 18*a* is longer than wall portion 18. Wall portion 18*a* also is longer than wall portion 16*a*.

Within pump 12*a* there will be some leakage from the outlet ports to their adjacent inlet ports. Leakage from low-pressure outlet port 48*a* to its adjacent inlet port 50*a* will be relatively low because of the small pressure differential between these ports. But leakage from high-pressure outlet port 52*a* to its adjacent inlet port 46*a* could be relatively high because of the large pressure differential therebetween. However, the increased length of wall portion 18*a* allows more teeth 32*a* to seal against this leakage In other words, there are more teeth to provide this sealing in the configuration of FIG. 2 than in the configuration of FIG. 1. The result is better sealing, reduced leakage, and improved efficiency in the high-pressure system of the pump.

This improved sealing is at the expense of less teeth 32*a* cooperating with wall portion 16*a* to seal against leakage from port 48*a* to port 50*a*. However, as the pressure differential between these ports is relatively low, fewer teeth are required to provide adequate sealing. Furthermore, the relatively high pressure in port 52*a* generates a biasing force which tends to move gear 28*a* away from port 52*a*. This enhances the sealing effect of teeth 32*a* and wall portion 16*a*.

It is well understood in the art that the particular size and shape of the various inlet and outlet ports is a matter of design choice. However, the designer should keep in mind the goal of providing sufficient gear teeth to seal against the aforementioned leakage from the high-pressure outlet port.

This invention discloses a three-gear, two-system pump which improves pump efficiency simply and inexpensively by reducing leakage from the high-pressure outlet port to its adjacent inlet port.

It should be understood that while the preferred embodiment of this invention has been shown and discribed, it is to be considered illustrative and may be modified by those skilled in the art. It is intended that the claims herein cover all such modifications as may fall within the spirit and scope of the invention.

What is claimed is:

1. In a three-gear, two-system pump including a housing defining first, second, and third overlapping chambers, a first inlet port and a low-pressure outlet port communicating with said first and second chambers, and a second inlet port and a high-pressure outlet port communicating with said first and third chambers; first, second, and third gears respectively rotatable on first, second, and third gear axes in said first, second, and third chambers, said first and second gears forming a first, low-pressure system pumping gear set, and said first and third gears forming a second, high-pressure system pumping gear set: the improvement wherein said first and second gear axes define a first pump axis, and said first and third gear axes define a second pump axis oriented transversely relative to said first pump axis such that said third gear is offset from said first and second gears toward said second inlet port.

2. In the three-gear, two-system pump of claim 1; said first chamber having a first wall portion extending from said low-pressure outlet port to said second inlet port, and a second wall portion extending from said high-pressure outlet port to said first inlet port: the improvement wherein said first wall portion is relatively short, and said second wall portion is relatively long.

3. In the three-gear, two system pump of claim 2; said first gear having a plurality of teeth cooperable with said wall portions to effect sealing: the improvement wherein a relatively small number of teeth is cooperable with said first wall portion to effect sealing against leakage from said low-pressure outlet port to said second inlet port, and a relatively large number of teeth is cooperable with said second wall portion to effect sealing against leakage from said high-pressure outlet port to said first inlet port.

* * * * *